US007551523B2

(12) United States Patent
Larian

(10) Patent No.: US 7,551,523 B2
(45) Date of Patent: Jun. 23, 2009

(54) ANIMATED CHARACTER ALARM CLOCK

(76) Inventor: Isaac Larian, c/o MGA Entertainment, Inc., 16380 Roscoe Blvd., Van Nuys, CA (US) 91406

( * ) Notice: Subject to any disclaimer, the term of this patent is extended or adjusted under 35 U.S.C. 154(b) by 0 days.

(21) Appl. No.: 12/027,991

(22) Filed: Feb. 7, 2008

(65) Prior Publication Data

US 2008/0192580 A1 Aug. 14, 2008

Related U.S. Application Data

(60) Provisional application No. 60/900,165, filed on Feb. 8, 2007.

(51) Int. Cl.
*G04B 19/00* (2006.01)
*A63H 3/28* (2006.01)

(52) U.S. Cl. ..... 368/274; 368/244; 368/278; 368/45; 446/298

(58) Field of Classification Search ..... 368/274, 368/229, 243–244, 276–317, 45; 446/369–372, 446/297–303
See application file for complete search history.

(56) References Cited

U.S. PATENT DOCUMENTS

| | | | | | |
|---|---|---|---|---|---|
| 344,922 | A | * | 7/1886 | Rebentisch | 368/229 |
| 2,586,938 | A | * | 2/1952 | Gowland | 446/312 |
| 2,620,594 | A | * | 12/1952 | Parisi | 446/298 |
| 4,098,068 | A | * | 7/1978 | Masuyama | 368/272 |
| 4,730,284 | A | | 3/1988 | Adams | |
| 4,742,500 | A | | 5/1988 | Luce | |
| 5,283,769 | A | | 2/1994 | Renton | |
| 5,318,469 | A | * | 6/1994 | Unalp et al. | 446/73 |
| 5,568,452 | A | | 10/1996 | Kronenberg | |
| 5,684,758 | A | * | 11/1997 | Gray et al. | 368/10 |
| D432,431 | S | * | 10/2000 | Robinson | D10/2 |
| 6,190,227 | B1 | | 2/2001 | Oba | |
| 6,380,844 | B2 | | 4/2002 | Pelekis | |
| 6,507,538 | B2 | | 1/2003 | Articola | |
| 6,560,802 | B2 | | 5/2003 | Fujii | |
| 6,620,024 | B2 | * | 9/2003 | Choi | 446/485 |
| 6,705,919 | B2 | | 3/2004 | Curran et al. | |
| 7,066,782 | B1 | * | 6/2006 | Maddocks et al. | 446/280 |
| 7,137,861 | B2 | * | 11/2006 | Carr et al. | 446/298 |
| 2004/0103222 | A1 | * | 5/2004 | Carr et al. | 710/1 |
| 2005/0277098 | A1 | | 12/2005 | Schmidt | |
| 2006/0234602 | A1 | | 10/2006 | Palmquist | |
| 2007/0189127 | A1 | * | 8/2007 | Pollak | 368/294 |
| 2007/0242225 | A1 | * | 10/2007 | Bragg et al. | 352/12 |

OTHER PUBLICATIONS

Waybackmachine :: web.archive.org/web/*/http://www.justclocks.co.uk/store/clock033.html; Jul. 29, 2008.*

Just Clocks :: justclocks.co.uk/store/clock033.html; May 11, 2006.*

User Guide Basic—robot -dog :: 2003.*

* cited by examiner

*Primary Examiner*—Vit W Miska
*Assistant Examiner*—Sean Kayes
(74) *Attorney, Agent, or Firm*—Intellectual Property Law Offices of Joel Voelzke, APC

(57) ABSTRACT

An animated toy alarm clock resembles a stuffed puppy, kitten, or other lovable creature. When the alarm is armed, the creature rotates or bows its limbs so that its body assumes a sleeping position. It may emit audible purring or other soothing noises for the relaxation of its owner. When the alarm goes off at the preset alarm time, the creature rotates or stretches its limbs so that its body rises into an awake position. It may emit barking, meowing, or other excited noises to awaken its owner to the world. The alarm clock may be conveniently disguised as a pet tag hung around an animal collar.

13 Claims, 3 Drawing Sheets

ANIMATED CHARACTER ALARM CLOCK

CROSS-REFERENCE TO RELATED APPLICATIONS

This application claims priority from U.S. provisional patent application No. 60/900,165 filed Feb. 8, 2007.

BACKGROUND OF THE INVENTION

1. Field of the Invention

The present invention relates generally to alarm clocks, and more particularly to toy alarm clocks resembling creatures which have motorized features.

2. Description of Related Art

A number of presently available novelty alarm clocks incorporate animal shapes with motorized features. Some are designed to awaken a user by moving their features in synchronization with animal sounds. Some alarm clocks emit animal sounds at the preset time. U.S. Pat. No. 4,730,284 discloses an animal figure perched on top of an alarm clock, with the assembly emitting a "cock-a-doodle-doo" or similar sound simultaneously with moving a part of the animal's body generally associated with the sound, such as the beak in the case of a rooster.

U.S. Pat. No. 6,554,679 discloses a playtoy such as a doll that automatically enters a sleep mode at a preset sleep time during which the playtoy remains quiet, and wakens at a preset hour of the day, issuing a verbal statement to let the player know it is time to again play.

Another patent, U.S. Pat. No. 4,742,500 discloses a stuffed bear with a clock removably positioned in its belly.

Other alarm clocks with motorized features, such as that shown in U.S. Pat. No. 5,283,769, move their features such that the animal or being appears to go to sleep when a preset time is reached. When the alarm activates at the preset alarm time, the clock moves its features such that the animal or being appears to awaken. Such alarm clock characters go to sleep and then waken without user interaction.

In going to sleep on its own, such an alarm clock may cause alienation from the toy in a young child. For example, the child may see that his or her toy friend goes to sleep without any interaction, so that the child feels like he or she has been abandoned at night. Without interaction, such as tucking it in, the toy might seem like it is too mechanical. Additionally, seeing the clock asleep one night in a toy chest then seeing it awake another day may cause emotional discomfort in the child.

Such alarm clocks also may waste batteries because the alarm clock will continue to automatically move its features to sleep then move its features to awake, day after day. If it is placed in such a position that the device cannot easily move, such as when it is placed into a toy chest and up against the walls of the chest or against other toys, the battery life will be depleted even more rapidly.

SUMMARY OF THE INVENTION

The present invention is of an alarm clock shaped like a living creature or other doll, and which provides a high degree of functionality, amusement, and interaction between the child and creature depicted. As used herein, the term "doll" shall be interpreted broadly to include without limitation a baby or other human doll, teddy bear, stuffed animal, animal character, toy robot, toy statue, action figure, mannequin, puppet or similar type of character resembling a living or animated being.

In the illustrative embodiment, the alarm clock takes the shape of a lovable animal such as a plush puppy dog. The alarm clock electronics including the controls and display are housed within a housing that is conveniently shaped like a pet tag hung around the dog's neck. Initially the dog is in a sitting up position. After the child has set the alarm to the preset time also called the wakeup time, when the child arms the alarm clock by turning the alarm arming ON/OFF switch to the ON position, the front and rear legs of the dog rotate forward thus causing the dog to move from a sitting up position to a prone or lying down position. This simulates the dog going to sleep. The animal could also emit one or more sounds associated with resting or sleeping, such as emitting a long sigh and/or then snoring for a short period of time. The animal therefore reacts to the child being ready to go to sleep and activating the alarm clock function by also going to sleep. This reinforces within the child the idea of going to sleep at the time that the child or her parents decide that it is bedtime.

When the alarm clock activates at the preset time (the alarm time set by the child, also referred to as the time to wake up), the front legs of the dog rotate backwards under motor power, and the hind legs of the dog simultaneously rotate backwards under a slight spring bias, thus causing the dog to assume a sitting up position, and thus simulating the dog waking up and sitting up. At the same time, a sound speaker located inside the dog emits barking sounds, thus audibly signaling to the child that it is time to wake up via an audible wakeup signal. The child awakens to find her dog awake, sitting up, and awakening her with its barking, much as a real dog might do.

The alarm clock preferably includes a snooze feature which is activated by interacting with the dog such as by pressing on a particular spot on the dog's forehead in the illustrative embodiment. When the child turns the alarm ON/OFF switch to the OFF position, the dog stops barking but remains in its sitting up position throughout the day until the child once more moves the switch to the ON position at bedtime.

More generally, when the alarm clock is armed the animal or other character moves an anatomical feature to a first position or body posture generally associated with rest or sleep, and may emit sounds associated with resting, going to sleep, and/or being asleep. When the alarm activates at the preset alarm time, the character moves from the first position or body posture to a second position or body posture that is generally associated with being awake and/or alert, and may emit one or more sounds associated with being awake and alert.

The clock battery, clock electronics, and clock controls and display may be disposed within a housing that is shaped like a pet tag hung around the animal's neck, with a hinged lid on the housing so as to cover the alarm clock display and controls. This makes the device's appearance more like a common plush animal toy that one might normally find in a child's room.

The improved character alarm clock of the present invention has a number of advantages over the prior art. The controls are simple. Because the animal responds to the child's input command by going to sleep when the child is ready for bedtime, the child psychologically associates with the animal and with the idea of lying down and going to sleep at bedtime. When the alarm clock activates in the morning, the child wakes up to the friendly sounds of a puppy barking to awaken its mistress, or other friend who is already awake and ready to play. The child will thus have an incentive to go to sleep when her animal friend goes to sleep at night, and to begin interacting in the morning with a world in which her pet dog or other play friend is already awake.

Additionally, placing the alarm clock electronics, controls, and displays within a simulated pet tag allows the alarm clock to take the form of a common plush toy without unnatural features such as a clock positioned within the animal's belly, which would be both unnatural in appearance and could induce a young child to attempt to play with an animal's belly. Furthermore, the child learns that information about an animal may be found on its collar tag. Still further, the wires connecting the alarm clock electronics to the actuator(s) within the animal may be routed through or behind the collar, entering the animal's body at the back of its neck. This construction allows the alarm clock electronics, displays, and controls to be placed outside of the animal's body in a place that is more natural, while allowing the wires to be hidden from view and relatively protected from damage during play.

Exemplary embodiments of the invention will be further described below with reference to the drawings, in which like numbers refer to like parts.

DETAILED DESCRIPTION OF THE PREFERRED EMBODIMENTS

Figure 1:
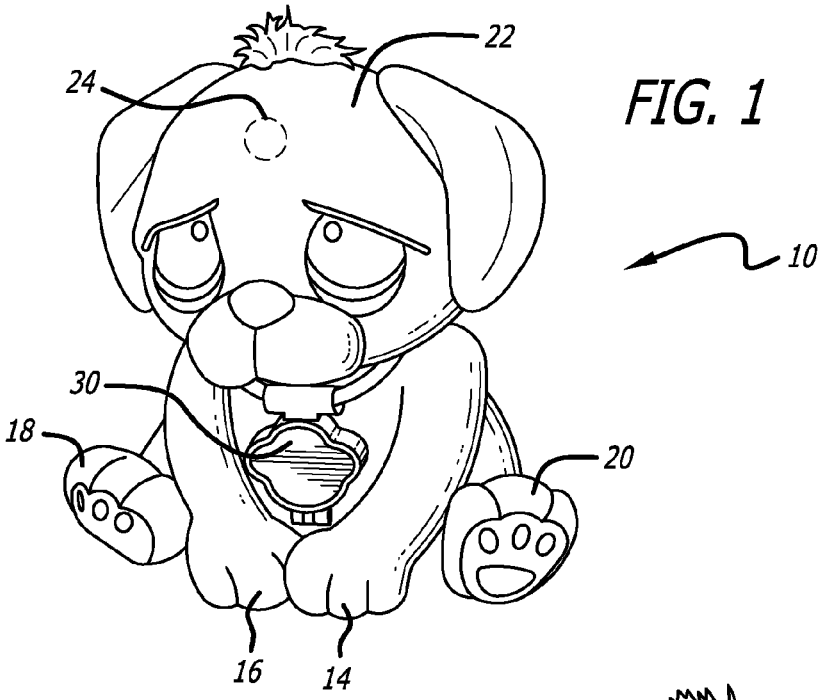
FIG. 1 is a front elevation view of a plush dog alarm clock according to an illustrative embodiment of the present invention, in a sitting up position.

With reference to FIG. 1, according to an illustrative embodiment of the present invention a doll takes the general form of a plush toy 10, in this case a plush dog toy. Dog 10 has a torso 12, two front legs 14 and 16, two hind legs 18 and 20, and a head 22. A housing 30 which may be in the location and generally in the form of a pet tag is affixed to the dog's neck. The tag may be affixed to the neck by a rope, chord, webbing, or other material generally simulating a pet collar which hangs around the dog's neck either somewhat loosely or held tightly to the dog's neck. Alternatively, the housing could be positively affixed directly to the front of the dog's neck, although it is preferred that the tag hang from a collar in order to generally simulate a pet tag hung on a collar extending around the dog's neck.

Figure 2:
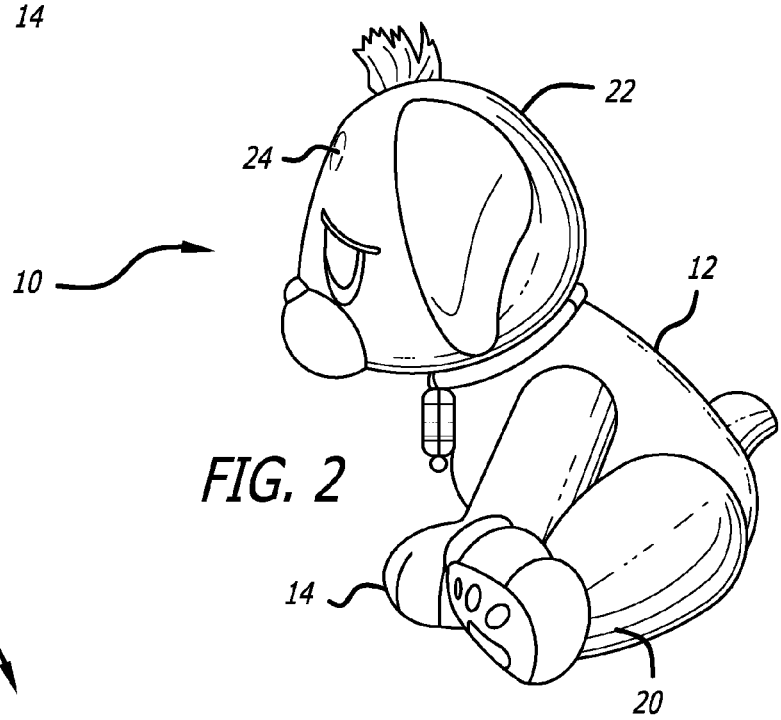
FIG. 2 is a side view of the plush dog alarm clock of FIG. 1.

FIGS. 1 and 2 show the dog in a generally sitting up, awake, and alert position. In this position hind legs 18 and 20 extend from the dog's torso 12 toward the direction in front of the dog, at roughly a ninety degree angle with respect to the torso. Front legs 14 and 16 extend downwards and slightly toward a direction in front of the dog, at roughly an angle of 50 degrees with respect to vertical and roughly 55 degrees with respect to the dog's torso.

Figure 4:
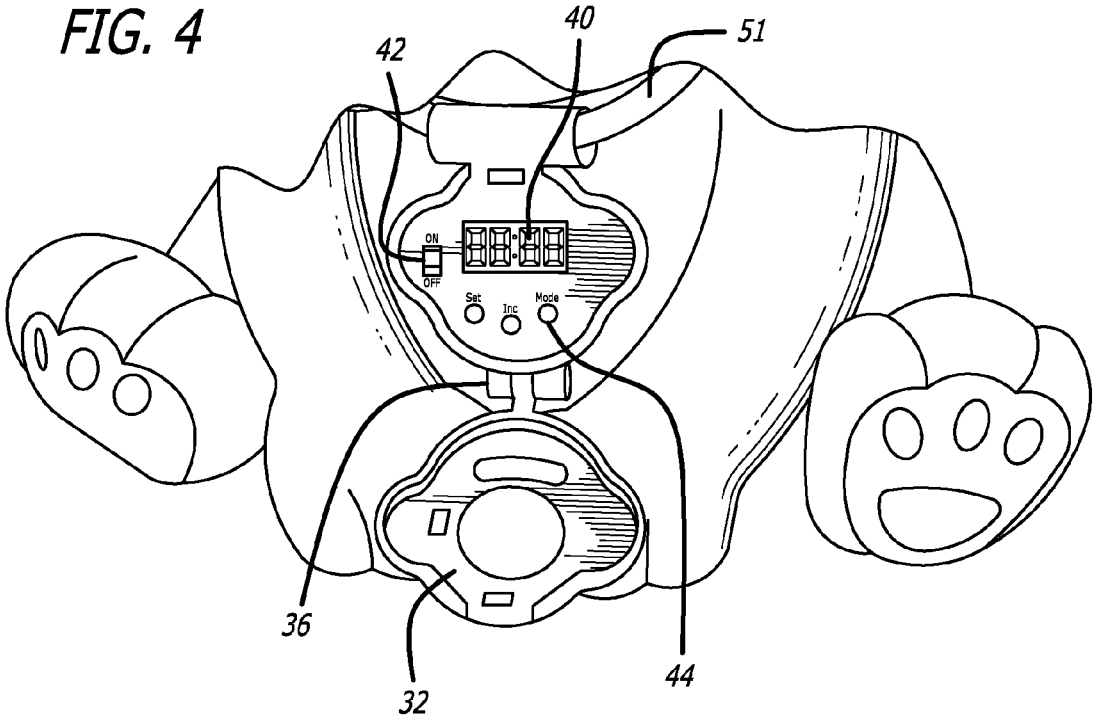
FIG. 4 is a close-up view of the alarm clock display and controls of the plush dog alarm clock of FIG. 1.

FIG. 4 is a close-up view of the alarm clock housing 30 of the plush dog of FIG. 1 with cover 32 open to reveal alarm clock display 40 and controls 42 and 44. Housing 30 is preferably in the general form and position of a pet tag, although it could take various different shapes, and need not be strictly in the position of a pet tag. The alarm clock controls and displays could, for example, be located on the outer surface of the dog, or under a fabric flap in the dog's stomach closed using a Velcro® type fastener, held in the animal's paws, or in many other places. Additionally, the controls and display could be placed in a hidden location such as the battery compartment location such as the one that will be described below. One or more controls could be activated by manipulating a body part of the dog. As an illustrative example, the alarm clock function could be armed by pushing down the ears of the dog, or closing its eyelids, or shaking its paw, or pressing on the underside of its foot, or in any number of other ways. The clock and alarm functions could also be set via remote control, through a wired or wireless computer interface, or in any number of other ways.

Housing 30 is affixed to the dog's neck via collar 51 which extends around the dog's neck. Collar 51 may be made of silk chord, nylon webbing, rope, or any other suitable material. In the preferred embodiment control wires extend out of housing 30 and up into collar 51, hidden within collar 51 to the back of the neck of the dog, and entering the dog's torso at the back of the neck. The routing of the wires, however, is not critical. In a preferred embodiment housing 30 has a back cover (not shown) that allows a clock battery that is separate from the actuator batteries to be accessed and changed. The clock battery is preferably a common watch type battery.

Housing cover 32 is hingedly connected to the remainder of housing 30 via hinge 36. Cover 32 preferably snaps loosely shut so that it can be easily opened and closed, and will remain closed when placed into the closed position. Alarm clock display 40 is preferably a typical alarm clock display such as a liquid crystal display (LCD) that displays the time of day, a.m. or p.m., and whether the alarm function is currently activated by an indicator such as a small icon of a bell being present when the alarm is armed. When the alarm set time is being changed, display 40 displays the alarm set time. Control buttons indicated generally at 44 are used to set the clock time and set the alarm time. An ON/OFF switch 42 arms the alarm function or disarms it. Such controls and displays are typical of small clocks and alarms, such as the functions on a digital watch with an alarm function, and are well known. Other types and configurations of alarm clock displays and controls may be used.

The child activates the alarm function, i.e., the child arms the alarm, by moving the alarm ON/OFF switch to the ON position. This also causes the doll to move from the sitting up, awake and alert position, to the resting or sleeping position. In the illustrative embodiment, the dog's front legs 14 and 16 rotate forward under the power of the motor by approximately 90 degrees. This causes the dog to transition from a sitting up position to the generally prone or lying down position shown in FIG. 3. Although the dog's hind legs 18 and 20 could also rotate under motor power, in a preferred embodiment the hind legs are not driven by motor power. Instead, the hind legs are freely rotatable and slightly biased via an internal biasing mechanism such as a spring toward the sitting position. The bias is strong enough to cause the hind legs to rotate backward under influence of the bias when the motor driven forward rotation of the front legs causes the dog to move from the lying position to the sitting up position. At the same time, the bias is weak enough such that when the motor driven rearward rotation of the front legs causes the dog to move from sitting to the lying position, the hind legs will also rotate forward against the bias force to allow the rear part of the dog to lie generally flat against the ground. In an illustrative embodiment, the rotational bias as measured at the distal portion of each rear leg is less than 2 lbs, and more preferably less than 1 lb., and more preferably still approximately 4-8 ounces.

Preferably there is a slight delay of a few seconds from the switch being moved to the ON position in order to arm the alarm clock feature, until the time that the dog transitions to its sleep position. This allows the child to arm the alarm feature and place the dog back down before it begins lying down.

The alert position associated with being awake and alert could include sitting or standing. The rest position associated with rest or sleep could include lying down or prone, or crouching. The rest position could also include sitting down if the doll is normally standing, such that the doll moves from standing to sitting when the alarm is activated, and moves back to a standing position when it is time to wake up.

One potential disadvantage of placing all of the alarm clock controls close together as shown in FIG. 4 is that a very young child, when trying to turn the alarm on or off via switch 42, might accidentally press the alarm and clock setting buttons 44, thus accidentally changing the time of day or the wakeup time. In an alternative embodiment therefore, the alarm ON/OFF switch 42 could be disposed in a location that is spaced apart from the alarm and clock setting control buttons 44. For example, alarm ON/OFF switch 42 could be placed somewhere on the animal's body, with the alarm and clock setting buttons 44 remaining under the pet tag cover 32. Locating the alarm ON/OFF switch in a separate location would make it harder for the child to accidentally change the clock or alarm time. The switch could take the form of a slide switch, a toggle switch, a knob, a bi-state touch switch, or any other type of switch. In a further variation, the alarm ON/OFF state could be controlled by manipulating a body part of the dog, such as pressing on the bottom of a foot, or by pressing the dog's stomach.

Figure 3:
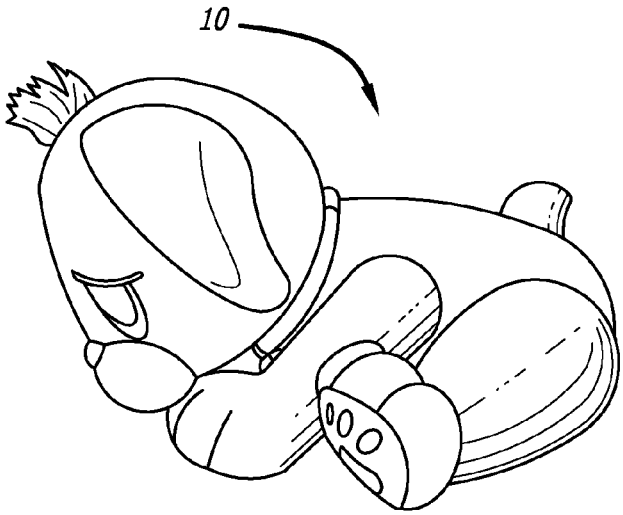
FIG. 3 is side view of the plush dog alarm clock of FIG. 1, in a lying down position.

FIG. 3 is a perspective view of the plush dog embodiment according to FIG. 1, in a lying down or prone position after the alarm has been set. In this position the doll has assumed a posture or position that is generally associated with resting and/or sleeping. Additionally, the dog's eyelids may close, and its ears and tail may go limp. Depending on the doll and the actuators inside of it, the doll may take other positions associated with rest or sleep. For example, a plush cat could curl up into a curled position with its tail wrapped around its body and its eyes closed. A bird could tuck its head into its body feathers. Many variations are possible.

When the preset alarm time is reached, i.e., when it is time to wake up, the front legs 14 and 16 rotate backward under motor power to their respective positions shown in FIG. 2, generally associated with the dog being awake and alert. Simultaneously the hind legs 18 and 20 rotate backwards under the influence of the bias spring. A sound producing speaker (not shown) located inside the dog makes barking noises to awaken its owner. As used herein, the term "speaker" is used in its broadest sense to encompass any sound producing transducer or mechanism. The dog could make other movements as well such as wagging its tail, flapping its ears, or bobbing or otherwise moving its head back and forth. For different animal figures, the alarm clock would produce different characteristic sounds, such as meowing in the case of a cat figure, mooing in the case of a cow figure, chirping in the case of a bird figure, etc.

A doll in the form of a human or humanoid figure could speak words associated with going to sleep and waking up, such as sighing and saying, "I'm sleepy" when the alarm is armed, and "Good morning. It's time to wake up" when it is wakeup time.

Preferably the alarm clock includes a snooze feature, which is a well known alarm clock feature. The snooze feature could be activated in any number of ways. In the exemplary embodiment, a touch switch 24 (FIG. 1) is positioned within the dog's forehead under the plush outer layer of the dog, such that pressing on the dog's forehead activates the snooze feature thus allowing the child to go back to sleep for several minutes before the alarm turns on again. In other embodiments, the snooze feature could be activated by touching or manipulating some other portion of the dog, such as manually closing its eyelids, shaking its paw, or manually moving one ear. When the snooze feature is activated, the dog could either return to its sleeping position or remain in its awake position during the snooze period.

The dog could have transitional states as well. For example, when it is time to wake up, the dog could initially rise partially up, with its eyelids partially open, and make a few groggy noises or soft whimpering or soft barking and cocking its head to the side looking inquisitively at its mistress for several minutes, before transitioning to a fully awake and excitedly barking state. The barking could become progressively louder over the course of several minutes in order to help ensure that the child actually wakes up. When the snooze feature is activated, the dog could return to its transitional state until the end of the snooze period.

Similarly, the dog could have transitional states when it is time to go to sleep. For example, when the child first turns the alarm function ON, the dog could first move part of the way but not completely down, and its eyelids could droop partially but not completely closed, and its tail could wag slowly before the dog finally goes to sleep. The animal could emit soothing noises for the relaxation of the child, such as purring in the case of a kitten figure. A human or humanoid doll could sing a lullaby. The child's pet friend would thus go slowly rather than abruptly to sleep, thus matching its owner in slowly and peacefully going to sleep. The transitional states would preferably be for at least an identifiable period of time, such as at least five seconds, or at least one minute, or at least five minutes. Many embodiments and variations are possible.

Figure 5:
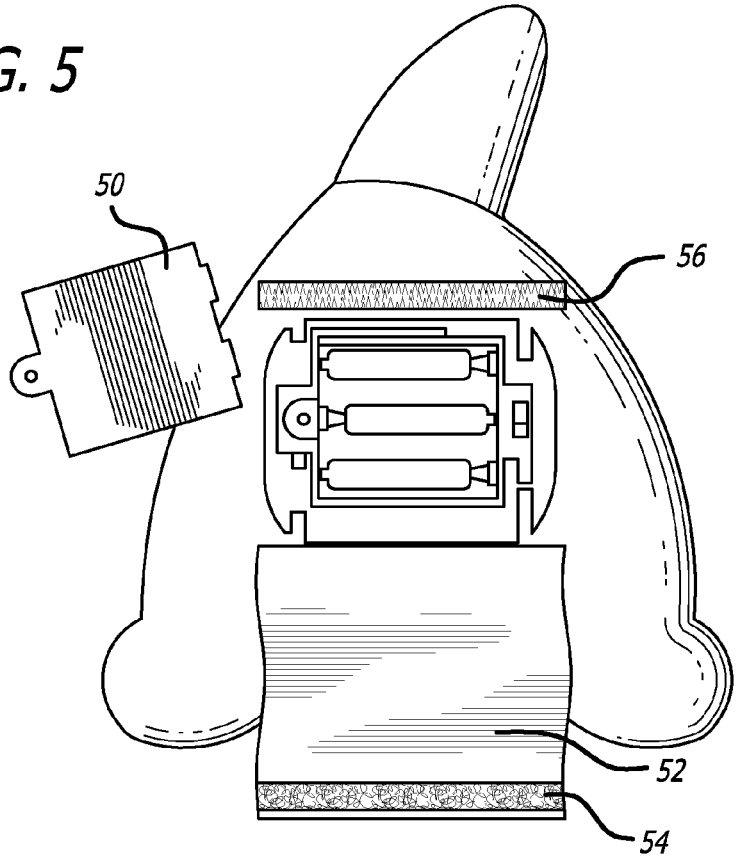
FIG. 5 is a view of the bottom of the plush dog alarm clock of FIG. 1, with the underside cover flap pulled back to reveal the battery compartment.

FIG. 5 is a view of the bottom of the plush dog of FIG. 1, with the underside cover flap 52 pulled back to reveal the battery compartment and the power ON/OFF switch. Battery cover 50 is shown removed. The flap material matches the plush material that covers the rest of the dog, and is held in the closed position by a Velcro® hook and pile fastener 54/56 or by other means. In the illustrative embodiment the batteries are three "AAA" batteries. The batteries power the actuators for making the dog move, and power the audible speaker. The type of batteries used for actuator power, the location of the battery compartment, and the location and type of the power switch, are not critical to the invention. Many variations are possible.

Figure 6:
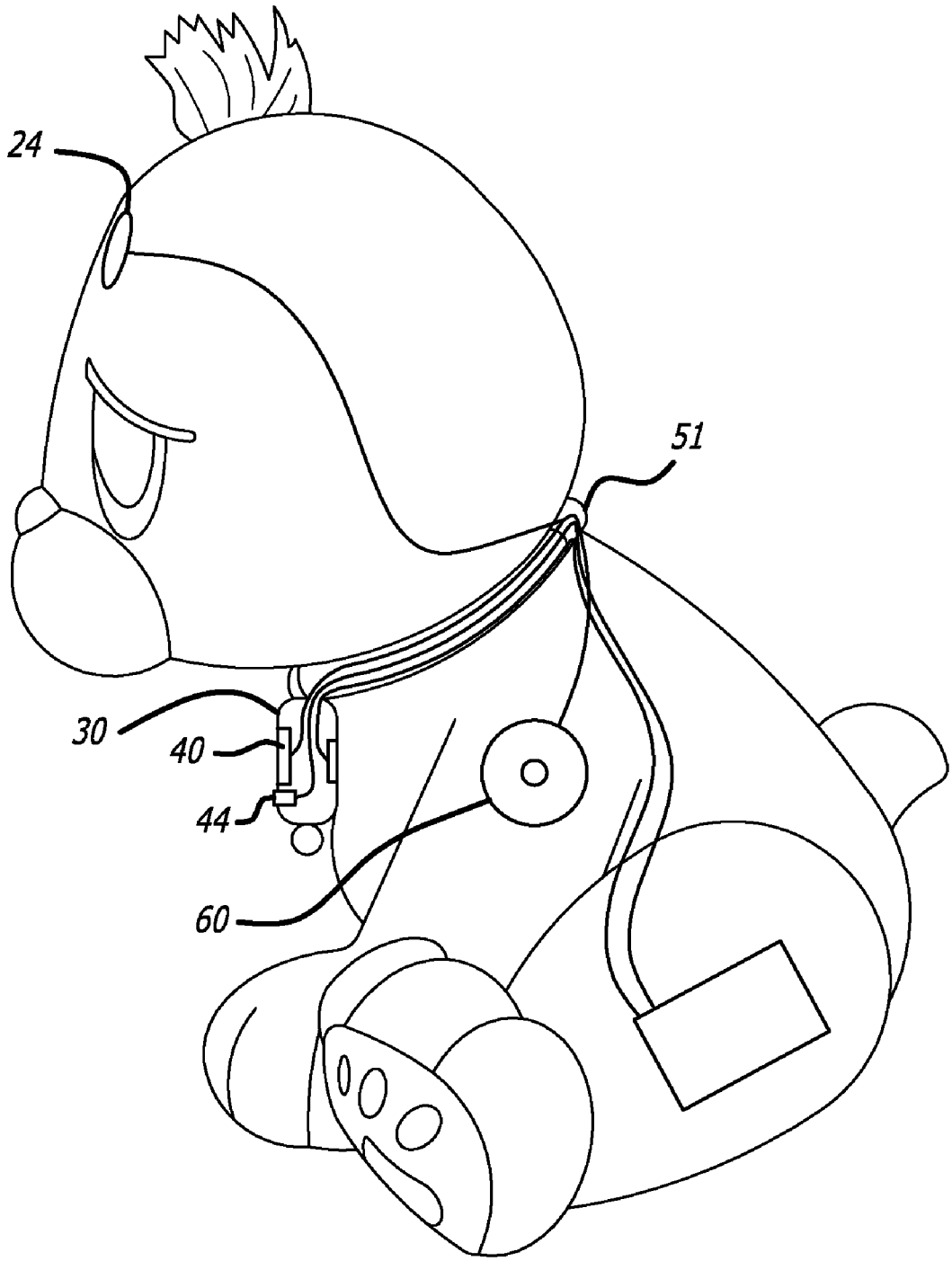
FIG. 6 is a schematic drawing of the plush dog alarm clock of FIG. 2, showing the internal wiring and the leg actuator.

FIG. 6 is a schematic drawing of the plush dog alarm clock of FIG. 2, showing the internal wiring which communicatively connects the alarm clock electronics within housing 30, snooze switch 24, and front leg actuator motor(s) 60. Snooze switch 24 and actuator(s) 60 are internal to the dog and are therefore hidden from view. Additional actuators may be used to cause movement of head 22 and of the tail.

The details regarding design, selection, layout, and interconnection of the alarm clock electronics, actuators, speakers, and other internal components and construction details, are within the skill of the ordinary artisan.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the alarm clock could take the form of any doll as defined herein. Various mechanisms could be used as actuators. The alarm clock display and controls could be located in various places on or within the doll or remotely from the doll. The doll could engage in various combinations of movements and sounds, both when going to sleep at night and when it is time to wake up. Lights could be added to the doll in various embodiments, especially robot or action figure embodiments. These variations are mere examples. Accordingly, it is to be understood that the detailed description and the accompanying drawings as set forth hereinabove are not intended to limit the breadth of the present invention, which should be inferred only from the following claims and their appropriately construed legal equivalents.

I claim:

1. An alarm clock comprising:

a dog figure having a torso and rotatably movable front legs, wherein said legs partially support said animal figure upon a surface;

a motor located within said animal figure and mechanically coupled to said front legs; and alarm clock electronics and communicatively coupled to said motor;

wherein arming said alarm clock causes said motor to rotate said front legs in a first direction such that said animal figure moves into a position which simulates the dog figure sleeping; and at a preset time, said motor rotates said front legs in a second direction opposite said first direction such that said animal figure rises into a sitting position, and a speaker produces an audible wakeup sound comprising barking.

2. The alarm clock of claim 1 wherein said animal figure further has two hind legs, the two hind legs being rotatable.

3. The alarm clock of claim 2 wherein said rotatable hind legs are each biased toward a sitting position, with a bias force within a sufficient range to allow said hind legs to:

rotate due to said bias force into a sitting position when said animal figure moves to said sitting position; and rotate against the bias force into a lying position when said front arms rotate in said first direction to cause said animal figure to assume said sleeping simulating position.

4. The alarm clock of claim 1 wherein said alarm clock electronics are disposed within a housing attached to a collar extending around a neck of the animal figure such that the housing simulates a pet tag hanging from a pet collar, the tag having a cover that when closed covers control buttons and a display of the alarm clock.

5. The alarm clock of claim 1 wherein manipulating a part of the dog figure's body activates an alarm snooze function.

6. The alarm clock of claim 1 wherein at said preset time, said dog figure also moves its head and wags its tail.

7. The alarm clock of claim 1 further comprising set buttons and an alarm arming switch, the arming switch being disposed in a separate location from said set buttons relative to said dog figure thereby preventing a child user from accidentally changing alarm or clock settings when arming the alarm clock.

8. The alarm clock of claim 1 wherein said position simulating the dog figure sleeping is selected from the group consisting of lying down and lying prone.

9. The alarm clock of claim 1 wherein said speaker emits a sound associated with being awake when said dog figure rises into said sitting position.

10. The alarm clock of claim 9 wherein said speaker further emits a sound associated with rest when said dog moves into said position which simulates the dog figure sleeping.

11. The alarm clock of claim 1 wherein the dog figure further assumes a third body position for an identifiable period of time, the third body position being a transitional position between the position which simulates the dog figure sleeping and the sitting position.

12. The alarm clock of claim 1 wherein said alarm clock electronics are affixed around a neck of said dog figure.

13. The alarm clock of claim 1 further comprising:

a housing having a shape and appearance of a pet tag, said housing being affixed around a neck of said dog figure, said housing containing therein said alarm clock electronics; and a cover hingedly connected to said housing, the cover concealing an arming switch and a display of said alarm clock when closed.

* * * * *